US008474119B2

(12) United States Patent
Lv et al.

(10) Patent No.: US 8,474,119 B2
(45) Date of Patent: Jul. 2, 2013

(54) BLIND-RIVET GUN

(75) Inventors: Qiang Lv, Shenzhen (CN); Yi-Lun Gan, Shenzhen (CN); Shang-Jun Li, Shenzhen (CN); Wen-Huan Liu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 103 days.

(21) Appl. No.: 13/186,742

(22) Filed: Jul. 20, 2011

(65) Prior Publication Data

US 2012/0174362 A1 Jul. 12, 2012

(30) Foreign Application Priority Data

Jan. 8, 2011 (CN) ..... 2011 1 0002983

(51) Int. Cl.
*B21J 15/22* (2006.01)

(52) U.S. Cl.
USPC ..... 29/243.525; 72/391.4

(58) Field of Classification Search
USPC ..... 29/243.523–243.525; 72/391.2, 72/391.4
See application file for complete search history.

(56) References Cited

U.S. PATENT DOCUMENTS 5,072,501 A * 12/1991 Vincenzo ..... 29/243.525
6,276,037 B1 * 8/2001 Solfronk ..... 29/243.525
6,918,279 B2 * 7/2005 Wille ..... 72/391.4

* cited by examiner

*Primary Examiner* — David B Jones
(74) *Attorney, Agent, or Firm* — Altis Law Group, Inc.

(57) ABSTRACT

A blind-rivet gun includes a gun header, a cylinder, a piston, and an air saving device. The cylinder is separated from the gun header. The piston and an inner surface of the cylinder form a seal to divide the cylinder into a first air chamber and a second air chamber. The air saving device includes a switch circuit. The switch circuit turns on a first connection between the air inlet pipe and the first air outlet pipe or turns on a second connection between the air inlet pipe, the second air outlet pipe and the third air outlet pipe. The piston slides in the cylinder to generate inner high pressure by alternatively supplying high pressure air to the first air chamber or the second air chamber. The blind-rivet is pulled in and is pushed out of the blind-rivet ejecting pipe by the inner high pressure.

18 Claims, 3 Drawing Sheets

BLIND-RIVET GUN

BACKGROUND

1. Technical Field

The present disclosure relates to mechanical tools, and particularly to a blind rivet gun.

2. Description of Related Art

A blind-rivet gun for setting blind-rivets is well known and is generally used in the following way. A blind-rivet having an internal thread in the inner periphery of a flanged sleeve is inserted and is fitted in, for example, mounting holes in two panels connected to each other, and a screw mandrel of the blind-rivet gun is threadedly connected to blind-rivets. The blind-rivet gun is often equipped with a barometric pressure apparatus, which provides barometric pressure. While the barometric pressure apparatus presses the flanged sleeve of the blind-rivet to the lateral sides of the panel mounting holes, the screw mandrel is retracted toward the inner side of the gun body to outwardly expand and deform the flanged sleeve. Thus, the two panels are secured to each other as pressed and held between the deformed sleeve and the flange. However, the barometric pressure apparatus is often combined with the blind-rivet gun and always turned on to provide barometric pressure, which wastes high pressure air.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
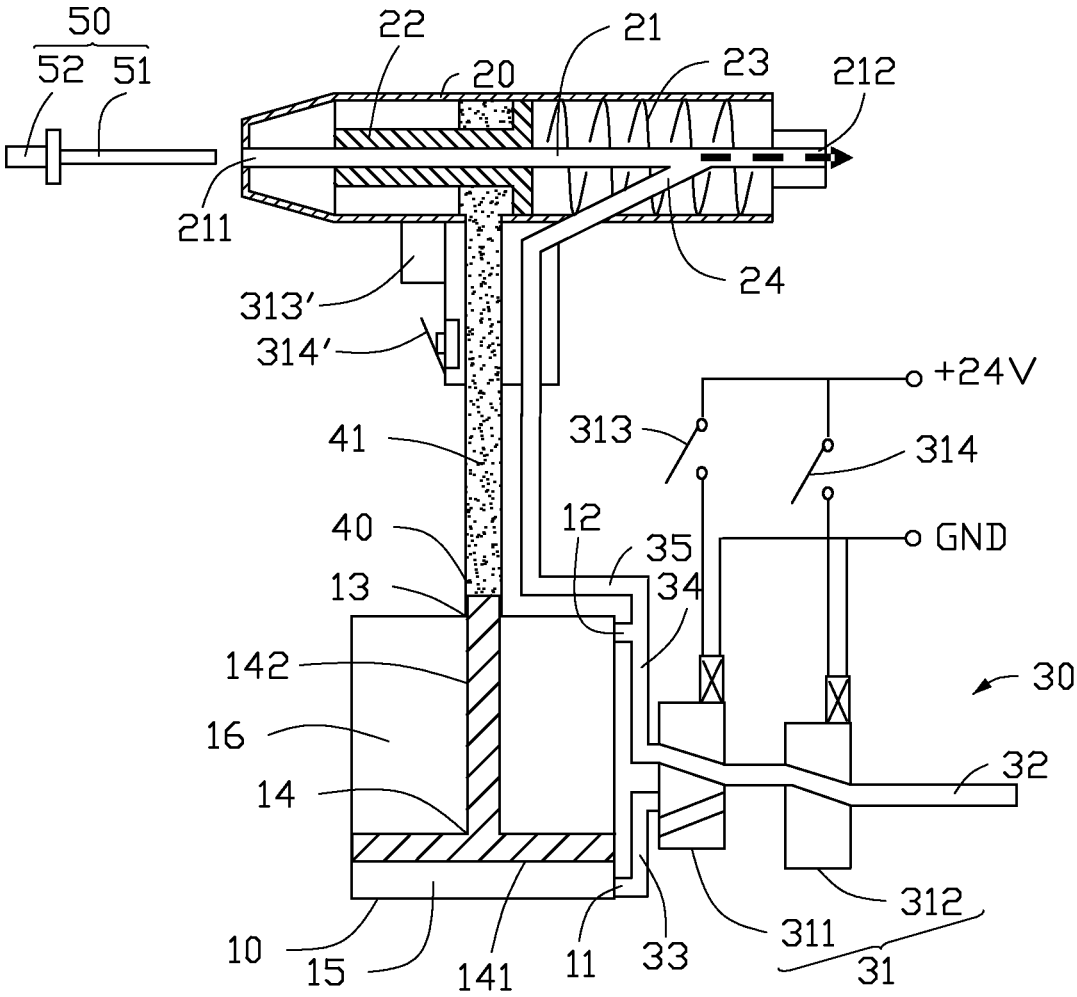
FIG. 1 is an isometric view of an embodiment of a blind-rivet gun shows the blind-rivet pulled in the blind-rivet gun.

Referring to FIG. 1, a blind-rivet gun in accordance with an embodiment, includes a cylinder 10, a gun header 20 and an air saving device 30.

The cylinder 10 is hollow and contains a reciprocating piston 14. The cylinder 10 includes a first air inlet opening 11 and a second air inlet opening 12 on one side and an air hole 13 on a top. The first air inlet opening 11 and the second air inlet opening 12 are connected to an inner space of the cylinder 10. The piston 14 includes a piston header 141 and a piston rod 142 connected to the piston header 141. The size of the piston header 141 is about the same as that of a cross section of the inner space of the cylinder 10.

The piston header 141 forms a seal with the inner surface of the cylinder 10, dividing the inner space of the cylinder 10 into a first air chamber 15 and a second air chamber 16. The piston rod 142 can slide in the air hole 13 of the cylinder 10. The first air chamber 15 is connected to the first air inlet opening 11. The second air chamber 16 is connected to the second air inlet opening 12. The cylinder 10 is connected to the gun header 20 via an oil pipe 40. The oil pipe 40 contains oil substance 41 therein. The piston header 141 can slide in the first air chamber 15 and the second air chamber 16 to adjust a barometric pressure in the gun header 20 by the oil substance 41.

The gun header 20 includes a blind-rivet ejecting pipe 21. A clamping member 22 is mounted on the blind-rivet ejecting pipe 21 for holding a blind-rivet 50. A blind-rivet inlet opening 211 is defined at a first end of the blind-rivet ejecting pipe 21. A blind-rivet outlet opening 212 is defined at a second end of the blind-rivet ejecting pipe 21. A spring 23 is fixed in the gun header 20 between the clamping member 22 and the blind-rivet outlet opening 212. A third air inlet opening 24 is defined on the blind-rivet ejecting pipe 21 for injecting high pressure air from a barometric pressure apparatus (not shown).

The blind-rivet 50 includes a blind-rivet header 51 and a blind-rivet tail 52. The gun header 20 can eject the blind-rivet 50.

The air saving device 30 includes a switch circuit 31, an air inlet pipe 32, a first air outlet pipe 33, a second air outlet pipe 34 and a third air outlet pipe 35. The air inlet pipe 32 is connected to the barometric pressure apparatus for receiving high pressure air. The first air outlet pipe 33 is connected to the first air chamber 15 via the first air inlet opening 11. The second air outlet pipe 34 is connected to the second air chamber 16 via the second air inlet opening 12. The third air inlet opening 24 is connected to the blind-rivet ejecting pipe 21. The second air outlet pipe 34 is connected to the third air outlet pipe 35. The switch circuit 31 includes a first valve 311 and a second valve 312. The first valve 311 includes a first valve anode and a first valve cathode. The second valve 312 includes a second valve anode and a second valve cathode. The first valve anode is electrically connected to a +24 volts working voltage via a first switch 313. The second valve anode is electrically connected to the +24 volts working voltage via a second switch 314. The first valve cathode and the second valve cathode are grounded.

Figure 2:
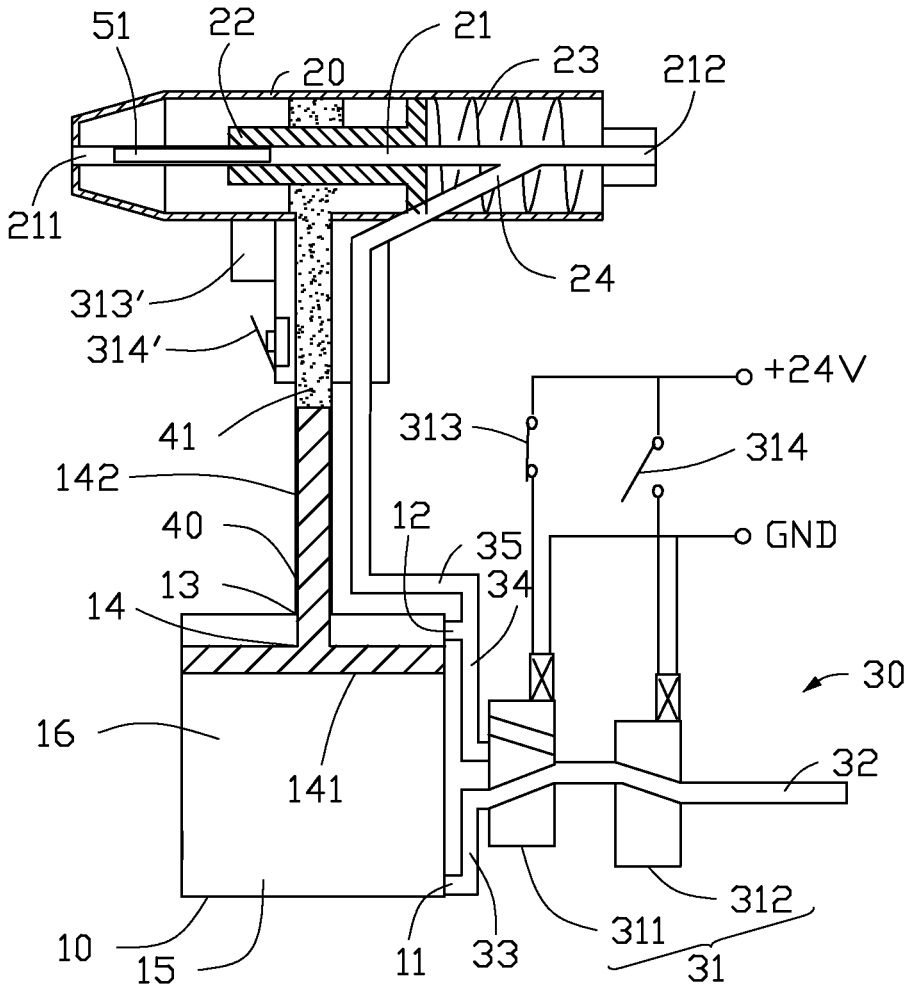
FIG. 2 is an isometric view of an embodiment of a blind-rivet gun shows the blind-rivet pressed in the blind-rivet gun.

When the second switch 314 is closed, the switch circuit 31 cuts off high pressure air from the barometric pressure apparatus; when the second switch 314 is opened, and the switch circuit 31 turns on high pressure air from the barometric pressure apparatus. When the second switch 314 is opened and if the first switch 313 is closed, the switch circuit 31 turns on the connection between the air inlet pipe 32 and the first air outlet pipe 33; the switch circuit 31 cuts off the connection between the air inlet pipe 32, the second air outlet pipe 34 and the third air outlet pipe 35 (as shown in FIG. 2). When the second switch 314 and the first switch 313 are opened, the switch circuit 31 turns on the connection between the air inlet pipe 32, the second air outlet pipe 34 and the third air outlet pipe 35; and the switch circuit 31 cuts off the connection between the air inlet pipe 32 and the first air outlet pipe 33 (as shown in FIG. 3).

A first button 313' and a second button 314' are disposed on a connection portion (not labeled) between the gun header 20 and the oil pipe 40. The first button 313' controls the first switch 313 to be closed or opened. The second button 314' controls the second switch 314 to be closed or opened. When the first button 313' is pressed, the first switch 313 is closed; when the first button 313' is released, the first switch 313 is opened. When the second button 314' is pressed, the second switch 314 is opened; when the second button 314' is released, the second switch 314 is closed.

Figure 3:
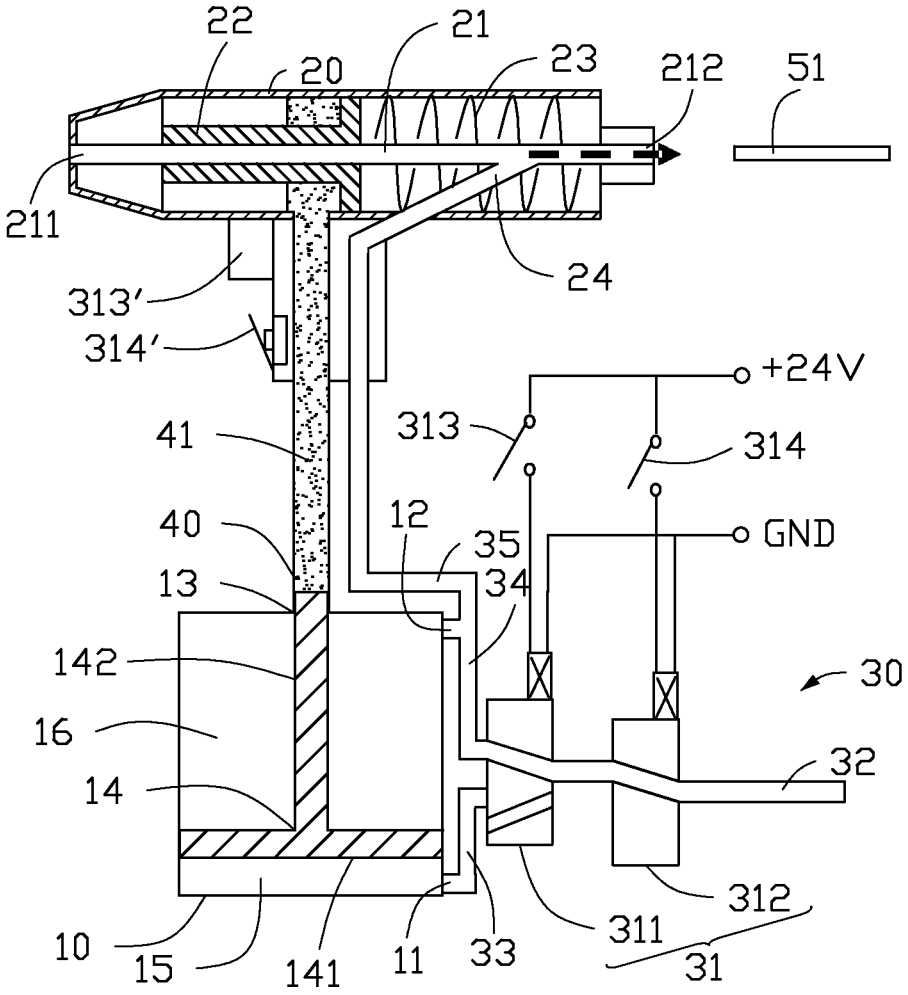
FIG. 3 is an isometric view of an embodiment of a blind-rivet gun shows the blind-rivet pushed out of the blind-rivet gun.

Referring to FIG. 1 to FIG. 3, when using the blind-rivet gun, the second button 314' is pressed to open the second switch 314, high pressure air from the barometric pressure apparatus is provided to the switch circuit 31. The switch circuit 31 turns on the connection between the air inlet pipe 32, the second air outlet pipe 34, and the third air outlet pipe 35, and cuts off the connection between the air inlet pipe 32 and the first air outlet pipe 33. High pressure air from the barometric pressure apparatus is supplied in the blind-rivet ejecting pipe 21 via the third air outlet pipe 35 and the third air inlet opening 24. The blind-rivet 50 is pulled in the blind-rivet ejecting pipe 21 and fixed on the clamping member 22 under the pressure of high pressure air.

The first button 313' is pressed to close the first switch 313. The switch circuit 31 turns on the connection between the air inlet pipe 32 and the first air outlet pipe 33, and cuts off the connection between the air inlet pipe 32, the second air outlet pipe 34 and the third air outlet pipe 35. High pressure air from the barometric pressure apparatus is supplied in the first air chamber 15 via the first air outlet pipe 33 and the first air inlet opening 11. The piston 14 moves toward the top of the cylinder 10. The piston rod 142 presses the oil substance 41 to move in the oil pipe 40 and enter the gun header 20. The oil substance 41 presses the clamping member 22 to slide in the gun header 20 along a first direction. The clamping member 22 clips the blind-rivet 50 to move together in the gun header 20 along the first direction under the pressure of the oil substance 41. The spring 23 is elastically deformed. The blind-rivet tail 52 is stopped by the blind-rivet inlet opening 211 and is separated from the blind-rivet header 51.

The first button 313' is then released to open the first switch 313. The switch circuit 31 turns on the connection between the air inlet pipe 32, the second air outlet pipe 34 and the third air outlet pipe 35, and cuts off the connection between the air inlet pipe 32 and the first air outlet pipe 33. High pressure air from the barometric pressure apparatus is supplied in the second air chamber 16 via the second air outlet pipe 34 and the second air inlet opening 12. High pressure air from the barometric pressure apparatus is also supplied in the blind-rivet ejecting pipe 21 via the third air outlet pipe 35 and the third air inlet opening 24.

The piston 14 moves toward a bottom of the cylinder 10. The piston rod 142 releases the oil substance 41 in the gun header 20. The plurality of oil substance 41 enters the oil pipe 40 and releases the clamping member 22. The clamping member 22 releases the blind-rivet header 51. The blind-rivet header 51 is pushed out of the blind-rivet outlet opening 212 by the pressure of high pressure air in the blind-rivet ejecting pipe 21. The clamping member 22 slides in the gun header 20 along a second direction opposite to the first direction. The spring 23 is elastically returned. The clamping member 22 returns to an original position in the gun header 20.

In one embodiment, high pressure air from the barometric pressure apparatus is only supplied in the blind-rivet ejecting pipe 21 during the process that the blind-rivet 50 is pulled in or pushed out of the blind-rivet ejecting pipe 21. However, high pressure air from the barometric pressure apparatus is not supplied in the blind-rivet ejecting pipe 21 during the process that the blind-rivet 50 moves in the blind-rivet ejecting pipe 21. Therefore, high pressure air is retained.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A blind-rivet gun, comprising:

a gun header comprising a blind-rivet ejecting pipe adapted to receive a blind-rivet;

a cylinder separated from the gun header;

a piston slidably mounted in the cylinder adapted to divide the cylinder into a first air chamber and a second air chamber; and an air saving device comprising:

a switch circuit;

an air inlet pipe connected to a barometric pressure apparatus for receiving high pressure air;

a first air outlet pipe connected to the first air chamber;

a second air outlet pipe connected to the second air chamber; and a third air outlet pipe connected to the blind-rivet ejecting pipe; wherein the switch circuit is adapted to turn on a first connection between the air inlet pipe and the first air outlet pipe or turn on a second connection between the air inlet pipe, the second air outlet pipe, and the third air outlet pipe; the piston is adapted to slide in the cylinder to generate an inner high pressure by alternatively supplying high pressure air to the first air chamber and the second air chamber; and the blind-rivet is adapted to be pulled in and pushed out of the blind-rivet ejecting pipe by the inner high pressure; wherein the switch circuit comprises a first valve; the first valve comprises a first valve anode and a first valve cathode; the first valve anode is electrically connected to an input terminal via a first switch; and the first valve cathode is grounded.

2. The blind-rivet gun of claim 1, wherein the piston comprises a piston header; and the piston header and an inner surface of the cylinder form a seal to divide the cylinder into the first air chamber and the second air chamber.

3. The blind-rivet gun of claim 2, wherein the switch circuit is adapted to turn on the second connection between the air inlet pipe, the second air outlet pipe and the third air outlet pipe; the switch circuit is adapted to turn off the first connection between the air inlet pipe and the first air outlet pipe; and the blind-rivet is adapted to be pulled in the blind-rivet ejecting pipe.

4. The blind-rivet gun of claim 3, further comprising a clamping member mounted on the blind-rivet ejecting pipe; the clamping member is adapted to hold the blind-rivet; the piston further comprises a piston rod; the cylinder is connected to the gun header via an oil pipe; the oil pipe contains oil substance therein; and the piston rod is adapted to slide in the oil pipe and press the plurality of oil substance.

5. The blind-rivet gun of claim 4, wherein the switch circuit is adapted to turn on the first connection between the air inlet pipe and the first air outlet pipe; the switch circuit is adapted to turn off the second connection between the air inlet pipe, the second air outlet pipe and the third air outlet pipe; the piston rod is adapted to slide in the oil pipe to press the oil substance; and the clamping member is adapted to clip the blind-rivet to move together in the gun header along a first direction.

6. The blind-rivet gun of claim 5, wherein when the clamping member and the blind-rivet move together in the gun header along the first direction, the switch circuit is adapted to turn on the second connection between the air inlet pipe, the second air outlet pipe and the third air outlet pipe and turn off the first connection between the air inlet pipe and the first air outlet pipe; the piston rod is adapted to release the oil substance; the clamping member is adapted to release the blind-rivet; and the blind-rivet is adapted to be pushed out of the blind-rivet ejecting pipe.

7. The blind-rivet gun of claim 6, wherein a spring is fixed in the gun header; the spring is elastically deformed when the clamping member and the blind-rivet move together in the gun header along the first direction; and when the blind-rivet is pushed out of the blind-rivet ejecting pipe, the spring is elastically returned to a non-compressed state, and the clamping member is adapted to slide in the gun header along a second direction, that is opposite to the first direction, and return to an original position in the gun header.

8. The blind-rivet gun of claim 1, wherein if the first switch is closed, the switch circuit is adapted to turn on the first connection between the air inlet pipe and the first air outlet pipe and turn off the second connection between the air inlet pipe, the second air outlet pipe and the third air outlet pipe; and if the first switch is opened, the switch circuit is adapted to turn on the second connection between the air inlet pipe, the second air outlet pipe and the third air outlet pipe and turn off the first connection between the air inlet pipe and the first air outlet pipe.

9. The blind-rivet gun of claim 1, wherein the switch circuit further comprises a second valve; the second valve comprises a second valve anode and a second valve cathode; the second valve anode is electrically connected to the input terminal via a second switch; the second valve cathode is grounded; when the second switch is closed, the switch circuit is adapted to cut off high pressure air from the barometric pressure apparatus; and when the second switch is opened, the switch circuit is adapted to turn on high pressure air from the barometric pressure apparatus.

10. The blind-rivet gun of claim 1, wherein if the first switch is closed, the switch circuit is adapted to turn on the first connection between the air inlet pipe and the first air outlet pipe and turn off the second connection between the air inlet pipe, the second air outlet pipe and the third air outlet pipe; and if the first switch is opened, the switch circuit is adapted to turn on the second connection between the air inlet pipe, the second air outlet pipe and the third air outlet pipe and turn off the first connection between the air inlet pipe and the first air outlet pipe.

11. The blind-rivet gun of claim 1, wherein the switch circuit further comprises a second valve; the second valve comprises a second valve anode and a second valve cathode; the second valve anode is electrically connected to the input terminal via a second switch; the second valve cathode is grounded; when the second switch is closed, the switch circuit is adapted to cut off high pressure air from the barometric pressure apparatus; and when the second switch is opened, the switch circuit is adapted to turn on high pressure air from the barometric pressure apparatus.

12. A blind-rivet gun, comprising:

a gun header comprising a blind-rivet ejecting pipe adapted to receive a blind-rivet;

a cylinder separated from the gun header; wherein the cylinder comprises a first air inlet opening and a second air inlet opening;

a piston slidably mounted in the cylinder adapted to divide the cylinder into a first air chamber and a second air chamber; wherein the first air chamber is connected to the first air inlet opening; and the second air chamber is connected to the second air inlet opening; and an air saving device comprising:

a switch circuit;

an air inlet pipe connected to a barometric pressure apparatus for receiving high pressure air;

a first air outlet pipe connected to the first air chamber via the first air inlet opening;

a second air outlet pipe connected to the second air chamber via the second air inlet opening; and a third air outlet pipe connected to the blind-rivet ejecting pipe; wherein the switch circuit is adapted to turn on a first connection between the air inlet pipe and the first air outlet pipe or turn on a second connection between the air inlet pipe, the second air outlet pipe and the third air outlet pipe; the piston is adapted to slide in the cylinder to generate an inner high pressure by alternatively supplying high pressure air to the first air inlet opening and the second air inlet opening; and the blind-rivet is adapted to be pulled in and pushed out of the blind-rivet ejecting pipe by the inner high pressure; wherein the switch circuit comprises a first valve; the first valve comprises a first valve anode and a first valve cathode; the first valve anode is electrically connected to an input terminal via a first switch; and the first valve cathode is grounded.

13. The blind-rivet gun of claim 12, wherein the piston comprises a piston header; and the piston header and an inner surface of the cylinder form a seal to divide the cylinder into the first air chamber and the second air chamber.

14. The blind-rivet gun of claim 13, wherein the switch circuit is adapted to turn on the second connection between the air inlet pipe, the second air outlet pipe and the third air outlet pipe; the switch circuit is adapted to turn off the first connection between the air inlet pipe and the first air outlet pipe; and the blind-rivet is adapted to be pulled in the blind-rivet ejecting pipe.

15. The blind-rivet gun of claim 14, further comprising a clamping member mounted on the blind-rivet ejecting pipe; the clamping member is adapted to hold the blind-rivet; the piston further comprises a piston rod; the cylinder is connected to the gun header via an oil pipe; the oil pipe contains oil substance therein; and the piston rod is adapted to slide in the oil pipe and press the plurality of oil substance.

16. The blind-rivet gun of claim 15, wherein the switch circuit is adapted to turn on the first connection between the air inlet pipe and the first air outlet pipe; the switch circuit is adapted to turn off the second connection between the air inlet pipe, the second air outlet pipe and the third air outlet pipe; the piston rod is adapted to slide in the oil pipe to press the plurality of oil substance; and the clamping member is adapted to clip the blind-rivet to move together in the gun header along a first direction.

17. The blind-rivet gun of claim 16, wherein when the clamping member and the blind-rivet move together in the gun header along the first direction, the switch circuit is adapted to turn on the second connection between the air inlet pipe, the second air outlet pipe and the third air outlet pipe and turn off the first connection between the air inlet pipe and the first air outlet pipe; the piston rod is adapted to release the oil substance; the clamping member is adapted to release the blind-rivet; and the blind-rivet is adapted to be pushed out of the blind-rivet ejecting pipe.

18. The blind-rivet gun of claim 17, wherein a spring is fixed in the gun header; the spring is elastically deformed when the clamping member and the blind-rivet move together in the gun header along the first direction; and when the blind-rivet is pushed out of the blind-rivet ejecting pipe, the spring is elastically returned to a non-compressed state, and the clamping member is adapted to slide in the gun header along a second direction, that is opposite to the first direction, and return to an original position in the gun header.

* * * * *